US012774596B2

(12) United States Patent
Thompson et al.

(10) Patent No.: US 12,774,596 B2
(45) Date of Patent: Oct. 27, 2026

(54) MODULAR BUILDING UNIT

(71) Applicant: MITEK HOLDINGS, INC., Wilmington, DE (US)

(72) Inventors: David Thompson, Winfield, PA (US); Jason Buchheit, New York, NY (US); Jared Adams, Mission Viejo, CA (US); Ben Downing, New York, NY (US)

(73) Assignee: MiTek Holdings, Inc., Wilmington, DE (US)

( * ) Notice: Subject to any disclaimer, the term of this patent is extended or adjusted under 35 U.S.C. 154(b) by 206 days.

(21) Appl. No.: 18/644,283

(22) Filed: Apr. 24, 2024

(65) Prior Publication Data

US 2024/0352723 A1 Oct. 24, 2024

Related U.S. Application Data

(60) Provisional application No. 63/497,865, filed on Apr. 24, 2023.

(51) Int. Cl.

| | |
|---|---|
| ***E04B 1/346*** | (2006.01) |
| ***E04B 1/348*** | (2006.01) |
| ***E04H 1/12*** | (2006.01) |

(52) U.S. Cl.

CPC ..... *E04B 1/34869* (2013.01); *E04B 1/34807* (2013.01); *E04H 1/12* (2013.01)

(58) Field of Classification Search

CPC .. E04B 1/348; E04B 1/34869; E04B 1/34807; E04H 1/00; E04H 1/02; E04H 1/12; E04H 1/125; E04H 1/1266

See application file for complete search history.

(56) References Cited

U.S. PATENT DOCUMENTS

| | | | |
|---|---|---|---|
| 5,224,321 | A | 7/1993 | Fearn |
| 5,345,779 | A | 9/1994 | Feeney |

(Continued)

FOREIGN PATENT DOCUMENTS

| | | | |
|---|---|---|---|
| CN | 210216910 | U | 3/2020 |
| WO | 2022103795 | A1 | 5/2022 |
| WO | 2022104034 | A1 | 5/2022 |

OTHER PUBLICATIONS

International Search Report and Written Opinion from PCT Application No. PCT/US2024/025965, mailed Oct. 2, 2024, 23 pages.

*Primary Examiner* — Chi Q Nguyen
(74) *Attorney, Agent, or Firm* — Stinson LLP

(57) ABSTRACT

A modular building unit has an interior space and is placed with other modular building units to form a building. The unit includes a first modular section having a first floor frame and a first wall frame extending up from the first floor frame. The first modular section defines a first portion of the interior space of the unit. The first floor frame underlies the first portion of the interior space of the unit. A second modular section includes a second floor frame and a second wall frame extending up from the second floor frame. The second modular section defines a second portion of the interior space of the unit. The second floor frame underlies the second portion of the interior space of the unit. A connection couples the first and second modular sections to one another. The first and second floor frames being generally coplanar with one another.

24 Claims, 12 Drawing Sheets

(56) References Cited

U.S. PATENT DOCUMENTS

| | | | | |
|---|---|---|---|---|
| 6,390,719 | B1 * | 5/2002 | Chan | E04B 1/5806 52/646 |
| 8,166,715 | B2 * | 5/2012 | De Azambuja | B65D 90/0006 52/79.5 |
| 8,347,560 | B2 * | 1/2013 | Gyory | E04B 1/34363 52/79.5 |
| 9,085,890 | B2 * | 7/2015 | Strickland | E04B 1/34321 |
| 9,988,806 | B2 * | 6/2018 | Segall | E04B 1/61 |
| 10,941,561 | B2 * | 3/2021 | Miller | E04B 1/388 |
| 11,236,519 | B2 | 2/2022 | Bellissimo et al. | |
| 12,084,853 | B2 * | 9/2024 | Cook | E04F 15/10 |
| 12,116,771 | B2 * | 10/2024 | Rafezy | E04B 1/3445 |
| 12,291,858 | B2 * | 5/2025 | Weatherby | E04B 1/34317 |
| 2012/0131878 | A1 | 5/2012 | Ivanov | |
| 2014/0007522 | A1 | 1/2014 | Wallance | |
| 2021/0062496 | A1 * | 3/2021 | Rittmanic | E04B 1/34352 |
| 2021/0180314 | A1 * | 6/2021 | Banerjee | E04B 1/3444 |
| 2022/0364354 | A1 | 11/2022 | Rafezy et al. | |
| 2024/0011283 | A1 * | 1/2024 | Bellissimo | E04B 1/34815 |
| 2025/0305272 | A1 * | 10/2025 | Huckaby | B29C 45/006 |

* cited by examiner

MODULAR BUILDING UNIT

CROSS-REFERENCE TO RELATED APPLICATIONS

The present application claims priority to U.S. Provisional Application No. 63/497,865, filed Apr. 24, 2023, the entirety of which is hereby incorporated by reference.

FIELD

The present disclosure generally relates to modular building units, and, more specifically, to the construction of a modular building unit.

BACKGROUND

Modular building units provide a modular system for rapidly erecting a building at a construction site (e.g., building or work site). In particular, the modular system facilitates arranging (e.g., stacking, placing side-by-side, placing end-to-end) multiple modular building units relative to each other to erect the building.

Each modular building unit may house a part of a room, a single room, or multiple rooms. For example, one modular building unit may house a kitchen and another modular building unit may house a dining room. In another example, one modular building unit may house a bedroom and a bathroom.

As shown in FIG. 1, one conventional way to create two rooms in a conventional modular building unit is installing a pod or submodule housing one of the rooms in the modular building unit and then constructing the second room in the remainder of the conventional modular building unit. For example, the conventional way of adding a bathroom within a conventional modular building unit 1 is to place a bathroom pod or submodule 2 within the conventional modular building unit. Keeping with the tenants of modular construction, this allows the bathroom pod 2 to be prebuilt (including all the plumbing, electrical wiring, plumbing fixtures (e.g., sinks, toilets, bathtubs, showers, etc.), vents, exhaust fans, and/or ductwork, etc.) and then installed in the conventional modular building unit 1. It is understood bathroom pods can be used in more conventional construction techniques as well. In either case, the bathroom pod 2 is placed on the floor. In the illustrated embodiment, the floor 4 of the bathroom pod 2 is placed on the floor 3 of the conventional modular building unit 1. As a result of this modular construction method, the floor 4 (e.g., the upper surface thereof) of the bathroom pod 2 is vertically offset or disposed above the floor 3 (e.g., the upper surface thereof) of the conventional modular building unit 1. This results in an occupant having to take a step either upward or downward when moving between the bathroom of the bathroom pod 2 and the room housed by the remainder of the conventional modular building unit 1. An occupant has to take a step up to the floor 4 of the bathroom pod 2 when entering the bathroom and has to take a step down to the floor 3 of the conventional modular building unit 1 when leaving the bathroom pod. Typically, the floor 4 of the bathroom pod 2 includes plumbing (and may include other utilities such as electrical wiring) which runs to the various different plumbing fixtures in the bathroom pod. After the bathroom pod 2 is installed at the construction site, the plumbing of the bathroom pod is connected to the plumbing of the building.

SUMMARY

In one aspect, a modular building unit has an interior space and is configured to be placed with at least one other modular building unit for use in forming a building. The modular building unit comprises a first modular section including a first floor frame and a first wall frame extending up from the first floor frame. The first modular section defines a first portion of the interior space of the modular building unit. The first floor frame underlies the first portion of the interior space of the modular building unit. A second modular section includes a second floor frame and a second wall frame extending up from the second floor frame. The second modular section defines a second portion of the interior space of the modular building unit. The second floor frame underlies the second portion of the interior space of the modular building unit. A connection couples the first modular section and the second modular section to one another. The first and second floor frames are generally coplanar with one another.

In another aspect, a method of constructing a modular building unit configured to be placed with at least one other modular building unit for use in forming a building comprises constructing a first modular section having a first floor frame and a first wall frame extending up from the first floor frame. This step includes the step of installing plumbing in at least one of the first floor frame and first wall frame for carrying fluid within in the first floor frame. The method also includes constructing a second modular section having a second floor frame. The second floor frame is free of plumbing for carrying fluid within the second floor frame. The method also includes coupling the first and second modular sections to one another. The coupling includes coupling the first and second floor frames to one another such that upper surfaces of the first and second floor frames are generally coplanar with one another.

In another aspect, a section of a modular building unit is configured to be placed with at least one other modular building unit for use in forming a building. The section comprises a floor frame. A wall frame is connected to the floor frame and extends up from the floor frame. A first tubular beam is connected to at least one of the floor frame and the wall frame. A connection member is at least partially received in the first tubular beam and is configured for connection to another section of the modular building unit for use in forming the modular building unit. The first tubular beam includes a cutout exposing at least a portion of the connection member to an outside of the tubular beam.

In another aspect, a section of a modular building unit is configured to be placed with at least one other modular building unit for use in forming a building. The section comprises a floor frame. A wall frame is connected to the floor frame and extends up from the floor frame. A connection member is configured for connection of another section of the modular building unit for use in forming the modular building unit. One of the floor frame and wall frame projects beyond the other of the floor fame and wall frame at an end of the section.

In yet another aspect, a method of constructing a building from modular building units comprises constructing a first modular section having a first floor frame and a first wall frame extending up from the first floor frame; constructing a second modular section having a second floor frame and a second wall frame extending up from the first floor frame; coupling the first and second modular sections to one another to form a modular building unit defining one or more rooms; and placing the modular building unit together with other modular building units to form at least part of a building.

In a further aspect, a modular building unit has an interior space and is configured to be placed with at least one other modular building unit for use in forming a building. The modular building unit comprises a first modular section including a first floor frame and a first wall frame extending up from the first floor frame. The first modular section defines a first portion of the interior space of the modular building unit. The first floor frame underlies the first portion of the interior space of the modular building unit. At least one of the first floor frame and the first wall frame includes a first projecting member extending laterally outward from the first modular section. A second modular section includes a second floor frame and a second wall frame extending up from the second floor frame. The second modular section defines a second portion of the interior space of the modular building unit. The second floor frame underlies the second portion of the interior space of the modular building unit. At least one of the first wall frame and the first floor frame includes a second projecting member extending laterally outward from the second modular section. A splice connection connects the first modular section to the second modular section. The splice connection includes a connection member secured to the first projecting member and the second projecting member thereby to connect the first and second modular sections for forming the modular building unit.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
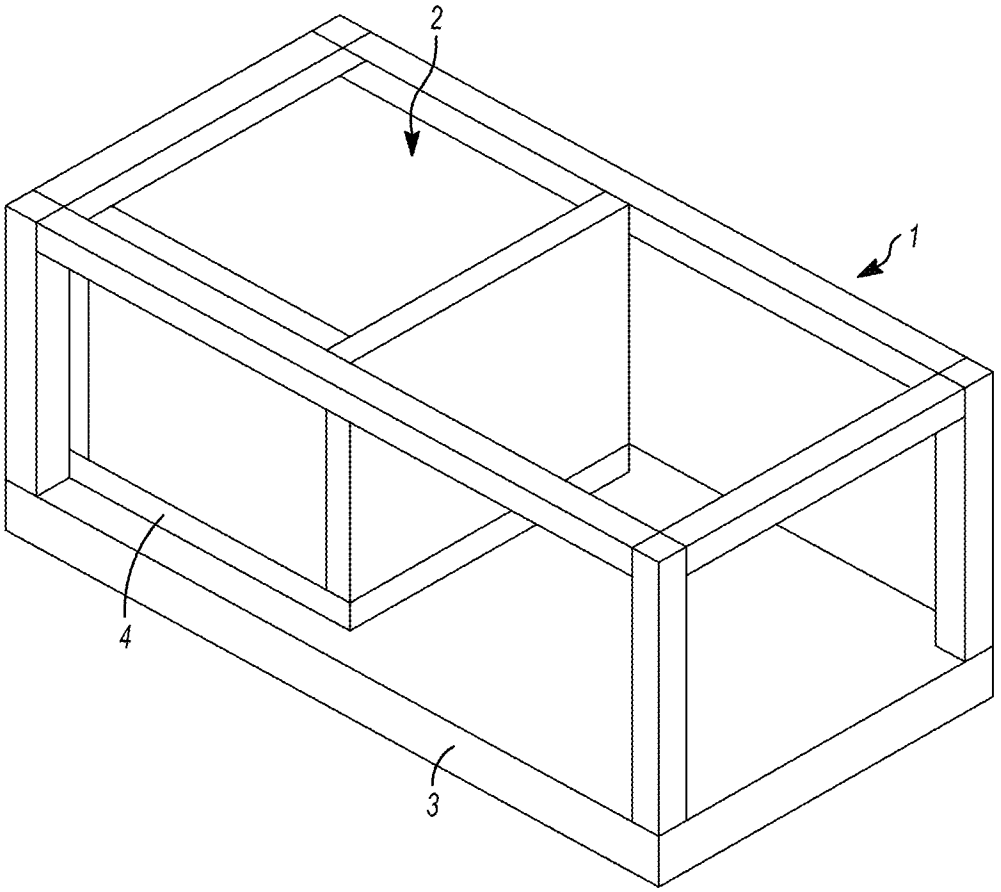
FIG. 1 (PRIOR ART)
FIG. 1 is an illustration of a conventional modular building unit with a conventional bathroom pod installed therein.
Figure 2:
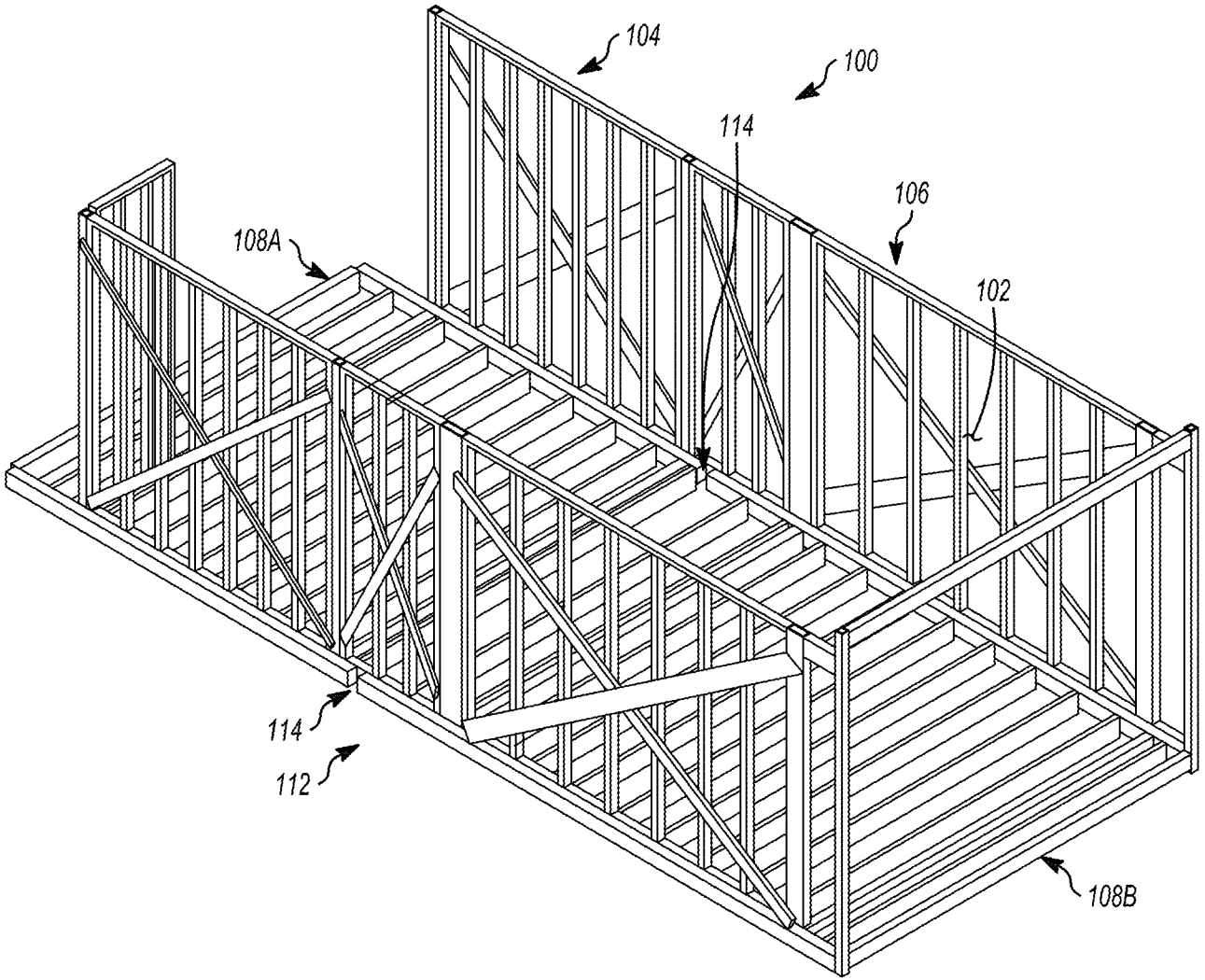
FIG. 2 is a perspective of a modular building unit according to one embodiment of the present disclosure.
Figure 3:
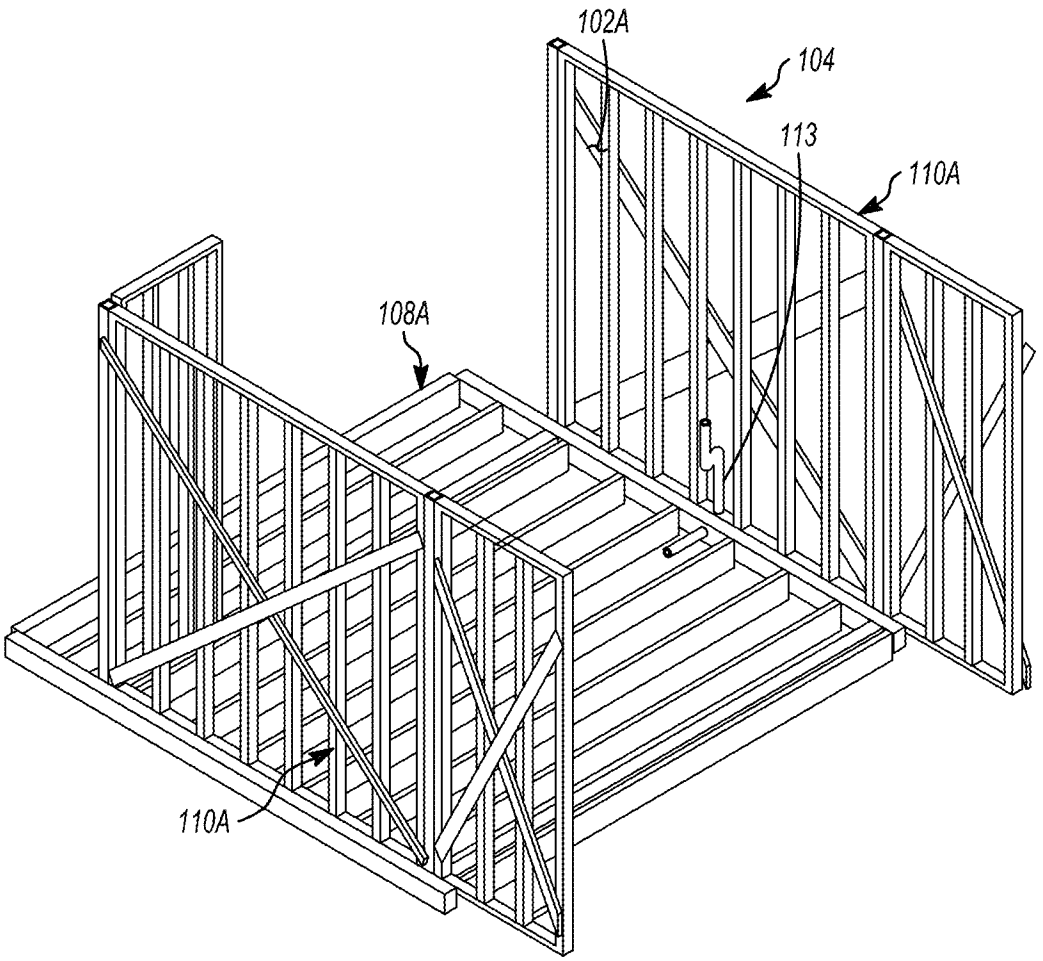
FIG. 3 is a perspective of a modular section of the modular building unit.
Figure 4:
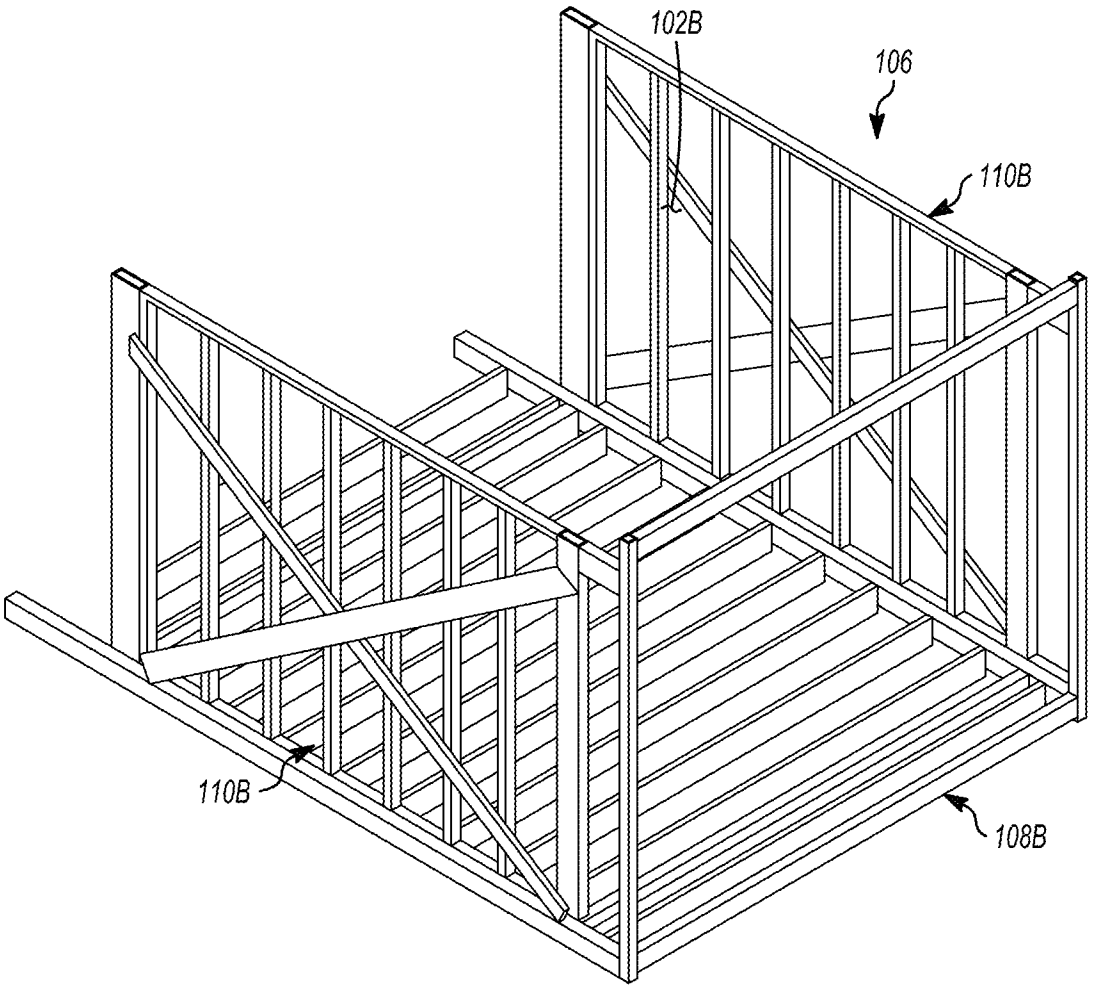
FIG. 4 is a perspective of another modular section of the modular building unit.

Referring to FIGS. 2-4, one embodiment of a modular building unit is generally indicated at reference numeral 100. Like conventional modular building units, the modular building unit 100 of the present disclosure is used to form a building. The modular building unit 100 is configured to be placed with other modular building units (broadly, at least one modular building unit) for use in forming the building. The modular building unit 100 has or defines an interior space 102 which can house one or more spaces or rooms (broadly, at least a portion of one or more spaces or rooms) of the building such as, but not limited to, a bathroom, a kitchen, a bedroom, a hallway, a dining room, a living room, a family room, an office, etc.

The modular building unit 100 includes two (e.g., first and second) modular sections 104, 106. It is understood the modular building unit may include more than two modular sections. As shown in FIG. 2, the first and second modular sections 104, 106 are coupled together to form the modular building unit 100. The modular building unit 100 is constructed for use in different types of construction, including without limitation balloon framing and platform framing. Each modular section 104, 106 defines a portion 102A, 102B (e.g., respective first and second portions) of the interior space 102 of the modular building unit 100. Each modular section 104, 106 includes a floor frame 108A, 108B (broadly, first and second floor frames). Each floor frame 108A, 108B underlies the corresponding portion 102A, 102B of the interior space 102 of the modular building unit 100. Each floor frame 108A, 108B includes opposite first and second header joists (broadly, opposite first and second elongate side structural members) with a plurality of joists extending therebetween. In the illustrated embodiment, each header joist comprises a tubular beam, such as a steel HSS beam. Each modular section 104, 106 also includes two wall frames 110A, 110B (e.g., first and second wall frames) (broadly, at least one wall frame).

Preferably, the wall frames 110A, 110B are structural or load bearing wall frames. In the illustrated embodiment, each wall frame 110A, 110B includes a sill, a header, a plurality of studs extending between the sill and header, and one or more diagonally oriented bracing members. Other configurations of the wall frames are within the scope of the present disclosure. Each wall frame 110A, 110B is connected to (e.g., mounted on) the respective floor frame 108A, 108B (e.g., an upper surface thereof). Each wall frame 110A, 110B extends generally upward from the respective floor frame 108A, 108B, specifically the header joist thereof. The number and construction of the wall frames can be other than described herein within the scope of the present disclosure. Moreover, the components of the floor frames 108A, 108B may be formed using other types of steel members or dimensional lumber within the scope of the present invention. In the embodiment illustrated in FIGS. 2-4, the modular sections 104, 106 each do not include a ceiling. In this embodiment, the ceiling and sub-ceiling may be installed after the modular sections 104, 106 are coupled together.

Referring to 5-7, in one embodiment, the modular sections 104, 106 of the modular building unit 100 each include a ceiling frame 111A, 111B (broadly, first and second ceiling frames). Except for the ceiling frames 111A, 111B, it is understood the modular sections 104, 106 of FIGS. 2-7 are similar to one another. In the illustrated embodiment, each ceiling frame 111A, 111B includes opposite first and second header joists (broadly, opposite first and second elongate side structural members) with a plurality of joists extending therebetween. Each header joist of the ceiling frames 111A, 111B may comprise a tubular beam, such as a steel HSS beam. However, it will be understood that the components of the ceiling frames may be formed by components other than HSS beam, such as non-tubular steel components and also from dimensional lumber. Each respective ceiling frame 111A, 111B is connected to and supported by the respective wall frames 110A, 110B.

The modular building unit 100 can define one or more rooms. In particular, the modular sections 104, 106 can each define one or more rooms. The floor frames 108A, 108B and wall frames 110A, 110B of the modular sections 104, 106 each define at least a portion of the one or more rooms of the modular building unit 100. Likewise, if present, the ceiling frames 111A, 111B of the modular sections 104, 106 each define at least a portion of the one or more rooms of the modular building unit 100. In one embodiment, the first and second modular sections 104, 106 each house a different type of room. For example, the first and second modular sections 104, 106 may each house one of a bathroom, a kitchen, a bedroom, a hallway, a dining room, a living room, a family room, or an office. For example, the first modular section 104 may house a kitchen or a bathroom and the second modular section 106 may house a bedroom, a dining room, an office, a family room, or a living room. Other types of rooms and other room configurations the modular sections house are within the scope of the present disclosure. Other configurations are also within the scope of the present disclosure. For example, in other embodiments, the first and second modular sections 104, 106 may together house a single room. In another example, the first and second modular sections 104, 106 may each house multiple rooms (or portions of multiple rooms).

Figure 5:
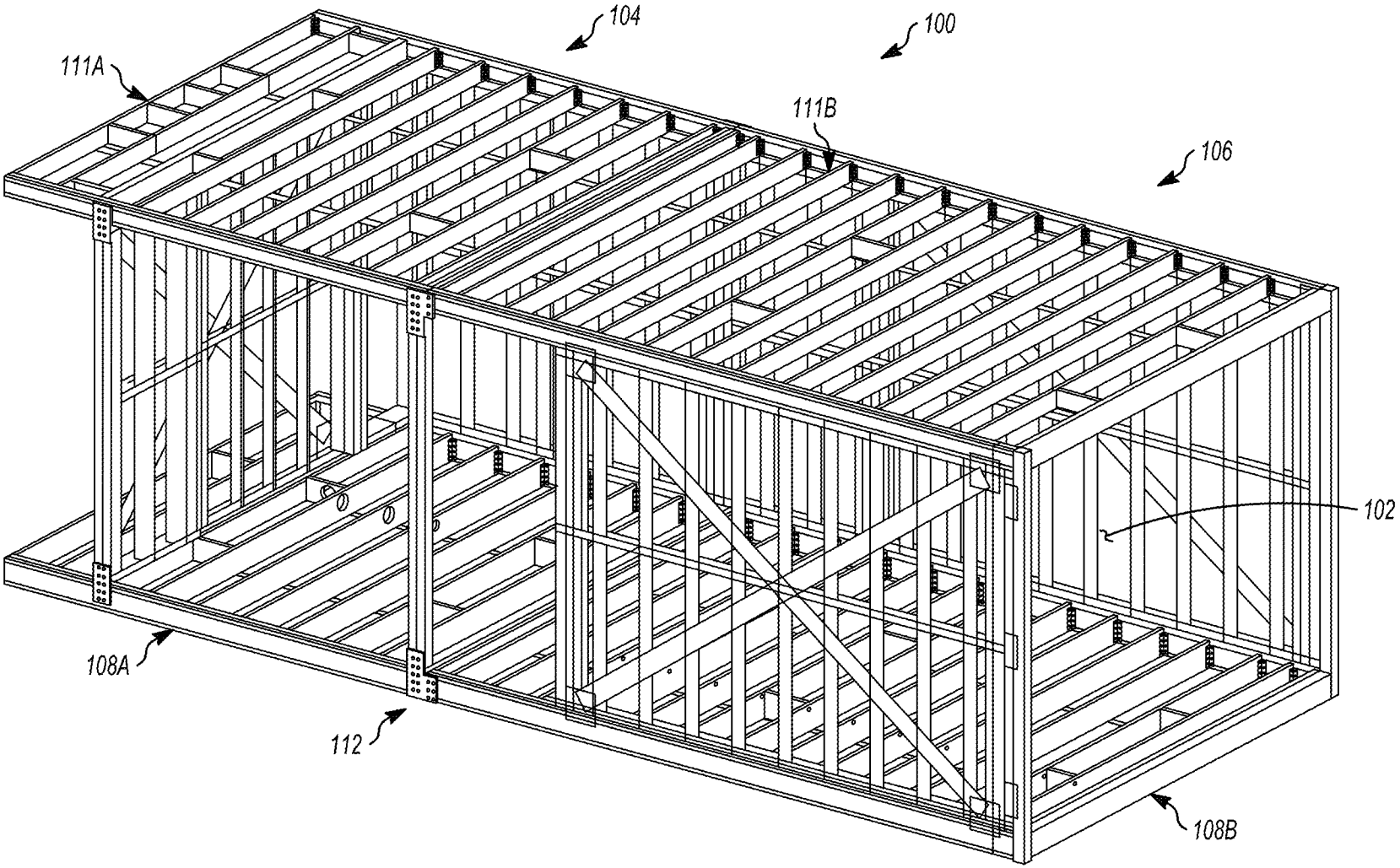
FIG. 5 is a perspective of a modular building unit according to another embodiment of the present disclosure.

The first and second modular sections 104, 106 are coupled together to form the modular building unit 100. As shown in FIG. 2, the first and second floor frames 108A, 108B are generally coplanar with one another. Preferably, the upper surfaces of the first and second floor frames 108A, 108B are generally coplanar with one another, such as vertically offset by about one inch (about 2.5 cm) or less. In another aspect, as the first and second modular sections 104, 106 are joined together, there is no step between the sections (e.g., the upper surfaces of the first and second floor frames are coplanar with one another). In one embodiment, the first and second modular sections 104, 106 are arranged to generally nest with or overlap one another. In this embodiment, one of the floor frame 108A, 108B and the wall frames 110A, 110B projects beyond the other of the floor frame and the wall frames at one end of the modular section 104, 106. As shown in FIGS. 2 and 3, the wall frames 110A of the first modular section 104 are constructed and arranged so that upon connection of the first and second modular sections 104, 106 to one another, the wall frames of the first modular section overlie the floor frame 108B of the second modular section (e.g., a portion of the floor frame). The wall frames 110A of the first modular section 104 overhangs or projects outwardly from the first floor frame 108A. Similarly, the second floor fame 108B of the second modular section 106 projects outwards from the wall frames 110B (e.g., ends thereof) of the second modular section. As shown in FIG. 5, if present, the first and second ceiling frames 111A, 111B are generally coplanar with one another when the first and second modular sections 104, 106 are coupled together. In this embodiment, the ceiling frames 111A, 111B, floor frames 108A, 108B, and/or wall frames 110A, 110B may not project beyond one another, as illustrated. Although, in one embodiment, one of the ceiling frames 111A, 111B and the wall frames 110A, 110B may project beyond the other of the ceiling frame and the wall frames at one end of the modular section 104, 106, as described above in relation to the floor frames 108A, 108B.

When the first and second modular sections 104, 106 are coupled together, the floor frames 108A, 108B form the floor or base of the modular building unit 100. Likewise, the frame walls 110A, 110B are generally coplanar with one another and form the side walls of the modular building unit 100. Additionally, if present, the ceiling frames 111A, 111B form the ceiling or roof of the modular building unit 100. In other words, the first and second modular section 104, 106 define at least a portion of a bottom, at least a portion of one side, and at least a portion of the other, opposite side of the modular building unit 100. Preferably, each modular section 104, 106 also defines at least a portion of one end of the modular building unit 100 and at least a portion of a top (e.g., ceiling or roof) of the modular building unit. The modular sections 104, 106 can define at least a portion of the top of the modular building unit with or without the ceiling frames 111A, 111B. For example, the top of the wall frames 110A, 110B can define at least a portion of the top of the modular building unit 100. Preferably, the first and second modular sections 104, 106 are dimensioned such that when coupled together to form the modular building unit 100, the modular building unit has overall dimensions that correspond to (e.g., match) the dimensions of the other modular building units used to construct the building. This allows the modular building unit 100 of the present disclosure to fit seamlessly with and be arranged relative to the other modular building units to construct the building.

The first and second modular sections 104, 106 are coupled to one another by a connection 112. The connection 112 permits the first and second modular sections 104, 106 to be attached to one another after each floor frame 108A, 108B is constructed (broadly, after each of the first and second modular sections 104, 106 are constructed). Preferably, the connection 112 permits the first and second modular sections 104, 106 to be attached to one another after the wall frames 110A, 110B are connected to their respective floor frames 108A, 108B (and after the ceiling frames 111A, 111B are attached to the wall frames). More preferably, the connection 112 permits the first and second modular sections 104, 106 to be attached to one another after at least a portion (preferably, all) of the utilities (e.g., plumbing, electrical wiring, outlets, switches, gas conduits, etc.) and/or at least a portion (preferably, all) of the finishing elements (e.g., drywall, light fixtures, plumbing fixtures, floor material (e.g., carpet, tile, wood, etc.), appliances, ceiling, vents, etc.) are installed in each modular section 104, 106. Such functionality allows each modular section 104, 106 to be built separately and then joined together. This ability is particularly useful when each modular section 104, 106 houses a different type of room, in particular different types of rooms requiring different utilities (broadly, building systems). For example, instead of constructing a single modular building unit (e.g., the conventional modular building unit 1) and then installing a separate pod (e.g., the bathroom pod 2) in it, as described in the Background section, the modular sections 104, 106 allow at least a portion of each room type to be built separately before connecting the modular sections together to form the modular building unit 100.

One advantage to the modular sections 104, 106 allowing at least a portion of each room type to be built separately is that this eliminates the offset floor issue described in the Background section. Because the modular sections 104, 106 are connected side-by-side to complete the full modular building unit 100, not one on top of the other, the floor frames 108A, 108B of the modular sections are positioned side-by-side and generally coplanar with one another. Moreover, having separate modular sections 104, 106 allows utilities (e.g., utility structures such as, but not limited to, plumbing, electrical wiring, outlets, switches, ductwork, gas conduits, etc.), which may be different and unique based on the type of room (e.g., a bathroom versus a bedroom) each modular section 104, 106 houses, to be installed before the two modular sections are joined together to form the modular building unit 100. As an example, a drain pipe 113 for a sink is shown in FIG. 3. The construction of the modular building unit 100 is such that the drain pipe 113 can go from the side wall of the modular building unit 104 into the floor frame 108A. A utility structure could similarly pass between the side wall and one of the ceiling frames 111A, 111B of the modular sections 104, 106. Because the two modular sections 104, 106 are separate before being connected together, the utilities of each modular section (particularly, the utilities disposed in the floor frame) can be generally completely installed. Thus, having separate modular sections 104, 106 provides the same benefit as the pods-allowing the room each modular section or pod houses to be at least partially (if not generally completely) constructed such as in a controlled factory setting-without then having an offset floor in the finished modular building unit. Similarly, the separate modular sections 104, 106 enables a sub-ceiling assembly to be attached to each modular section (e.g., the ceiling frames 111A, 111B thereof) to allow for the installation of any electrical and/or mechanical (e.g., lights, ductwork, vents, fans, etc.) needs in the sub-ceiling assembly before the modular sections are coupled together and the final ceiling assembly is installed. In some embodiment, the ceiling frames 111A, 111B may be part of the sub-ceiling assembly.

Referring to FIGS. 8A-D, one embodiment of the connection 112 is generally shown. In this embodiment, the connection 112 comprises at least one splice connection 114. In the illustrated embodiment (FIG. 2), the connection 112 comprises two splice connections 114, although more or fewer splice connections are within the scope of the present disclosure. The splice connections 114 are generally identical so one splice connection will now be described with the understanding the description applies to the other splice connection. The splice connection 114 comprises a first connection element 116A associated with the first modular section 104 and a second connection element 116B associated with the second modular section 106. The first connection element 116A can be considered a first projecting member, and the second connection element 116B can be considered a second projecting member. The projecting members 116A, 116B are preferably part of either the floor frame (e.g., floor frames 108A, 108B) or the wall frame (e.g., wall frames 110A, 110B). The first and second connection elements 116A, 116B are configured for connection to each other to form the modular building unit 100 from the first and second modular sections 104, 106. The first and second connection elements 116A, 116B are generally similar to one another. The first and second connection elements 116A, 116B each comprise a tubular beam 118A, 118B (e.g., an end portion thereof) and a connection member or plate 120A, 120B carried by the tubular beam. Again, other components beside a tubular beam may be employed, including without limitation other steel components and dimensional lumber.

Each connection member 120A, 120B is at least partially disposed within a respective one of the tubular beams 118A, 118B. The connection members 120A, 120B are configured to be secured together (broadly, each connection member is configured to be secured to the other modular section). The tubular beam 118A, 118B includes a cutout 122A, 122B positioned to expose at least the portion of the connection member 120A, 120B. The cutout 122A has the same shape as cutout 122B, but flipped about a horizontal axis that extends along the center of the tubular beams 118A, 118B. The cutout 122A, 122B exposes the connection member 120A, 120B to the environment outside the tubular beam 118A, 118B. Together the cutouts 122A, 122B cooperatively form a window 124 when the first and second connection elements 116A, 116B are mated together to provide access to the connection members 120A, 120B through the window. The cutouts 122A, 122B are preferably included on both sides of the tubular beams 118A, 118B. The connection members 120A, 120B overlap one another when the first and second connection elements 116A, 116B are mated together. The connection members 120A, 120B include fastener openings that align with each other. Fasteners 126 (e.g., bolts) are inserted through the aligned openings to secure the first and second connection elements 116A, 116B together. In the illustrated embodiment, the first and second connection elements 116A, 116B are a portion of the floor frames 108A, 108B of the respective first and second modular sections 104, 106. Specifically, the tubular beams 118A, 118B forming the splice connection 114 are part of the floor frames 108A, 108B (e.g., are part of the first and second elongate side structural members of the floor frames).

In other embodiments, the tubular beams forming the splice connection could be additionally or exclusively part of the wall frames (such as the sill or the header), the ceiling frames (such as the elongate side structural members of the ceiling frames) or the tubular beams could be a separate component connected to the floor frame, ceiling frame, or wall frame. Broadly, the tubular beams are connected to at least one of the floor frame, ceiling frame, or the wall frame of modular section. In addition to the splice connections 114, the connection 112 may include other methods of attaching the first and second modular sections together. For example, the frame walls of the modular sections can be secured together, such as by welding, other kinds of fasteners (e.g., screws), etc.

In still other embodiments, a connection member or connection members (not shown) could be applied to the exterior of beams (e.g., similar to beams 118A, 118B) to form a splice connection. In one example, the beams could be formed of dimensional lumber. The beams from the modular sections can be butted together at a joint. One or more connection members are laid over the joint so that the connection members each extend on opposite sides of the joint. In one version, for each pair of butted beams, two connection members are disposed on respective opposite sides of the joint and beams. The connection members can be attached to the beams in a suitable manner, such as be screws driven through the connection members and beams. In all cases, the spliced joint allows the joined beams to function essentially as a single, continuous beam in the modular building unit formed from the modular sections.

Figure 6:
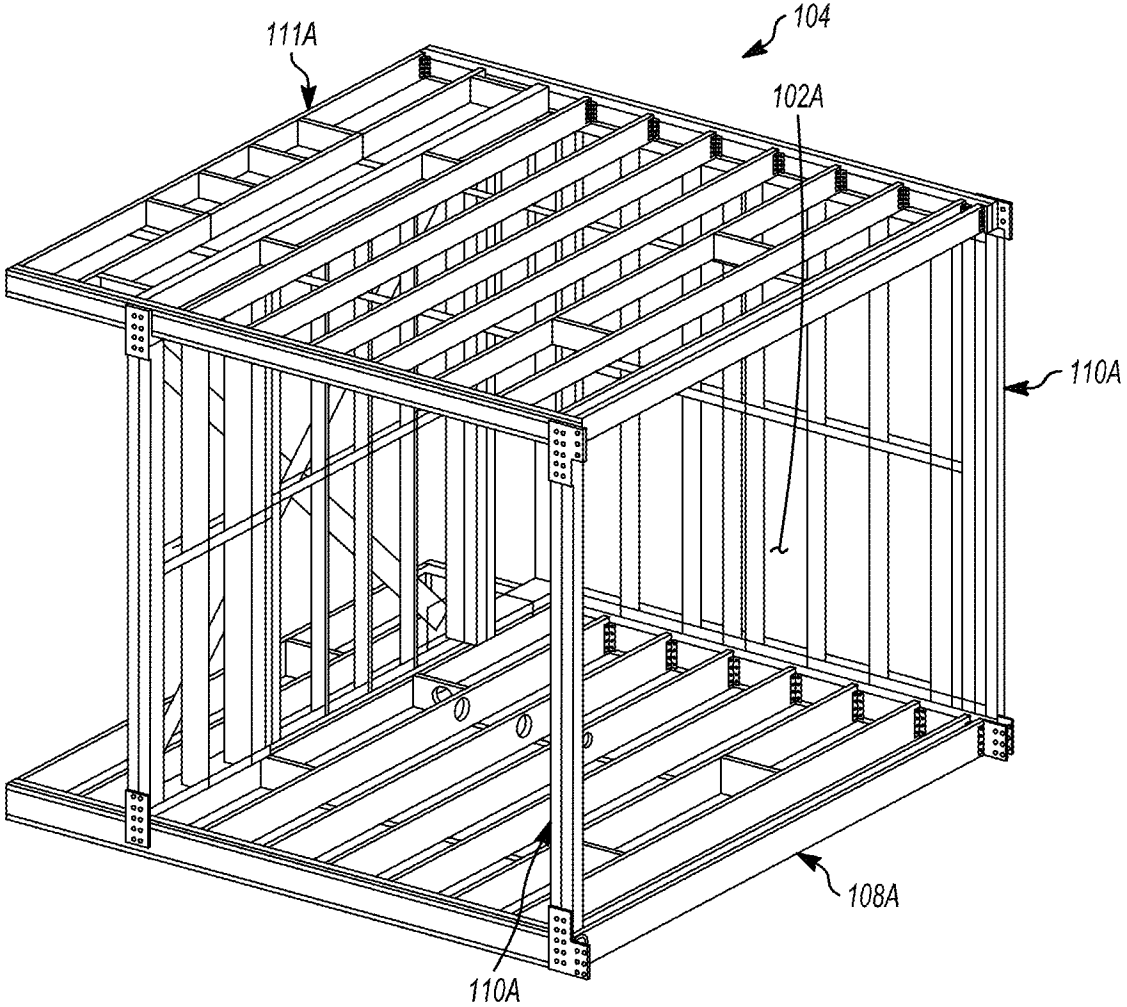
FIG. 6 is a perspective of a modular section of the modular building unit of FIG. 5.
Figure 7:
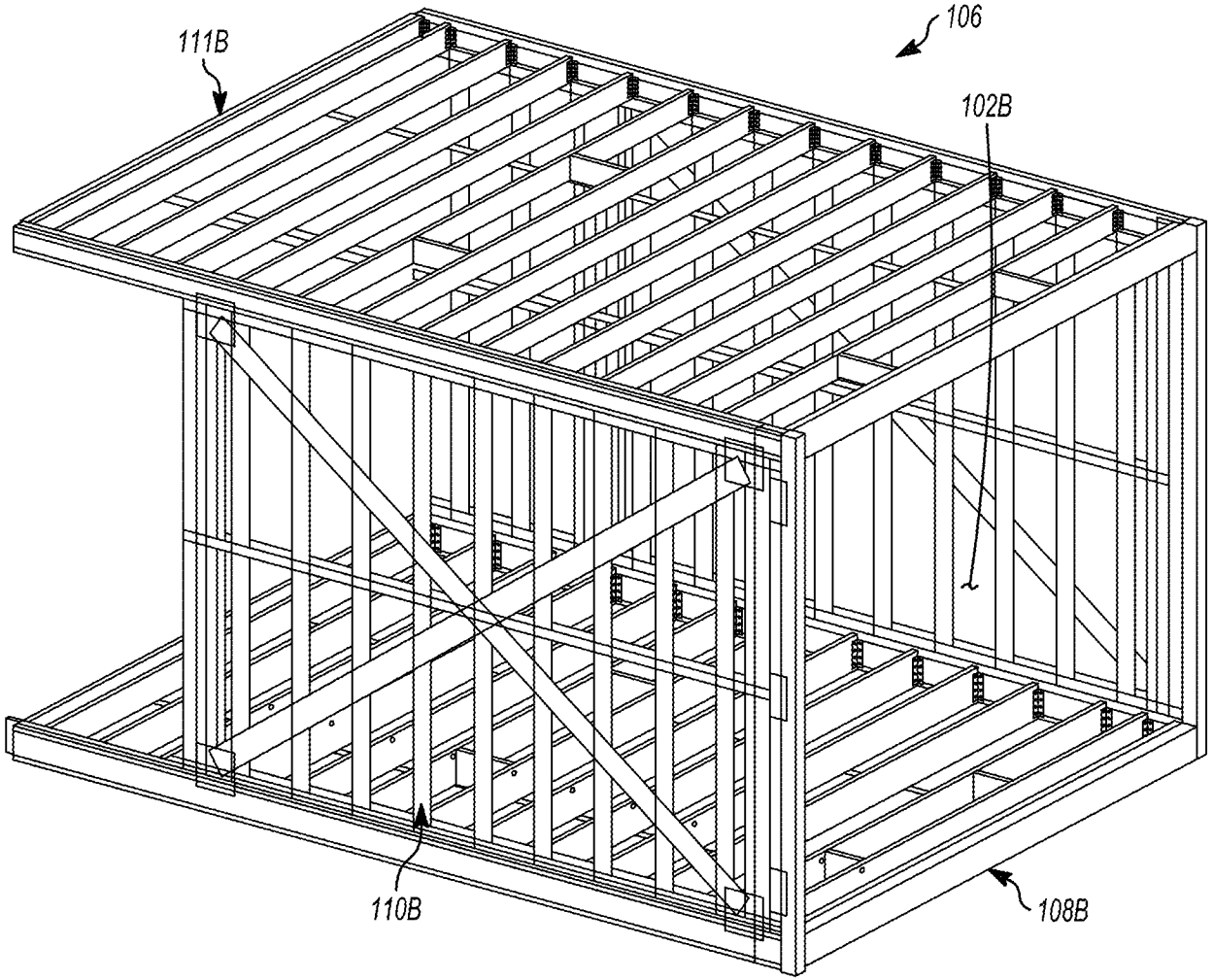
FIG. 7 is a perspective of another modular section of the modular building unit of FIG. 5.
Figure 8A:
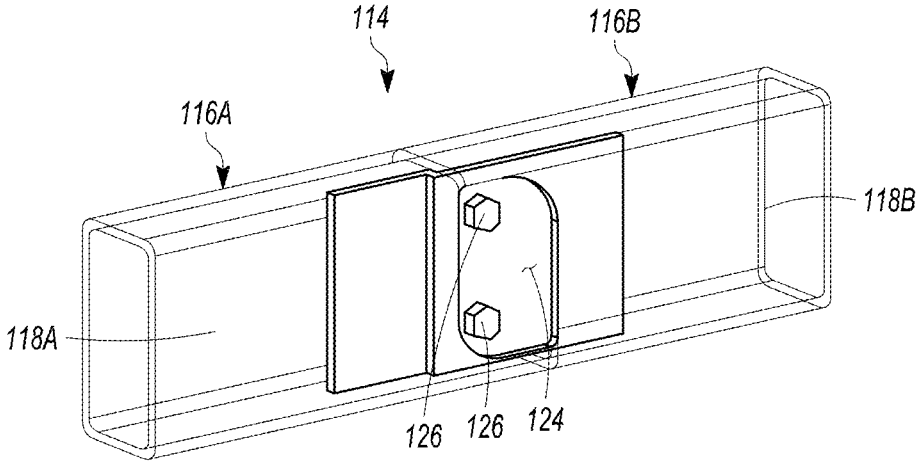
FIGS. 8A-D are views illustrating a connection between the modular sections.
Figure 8B:
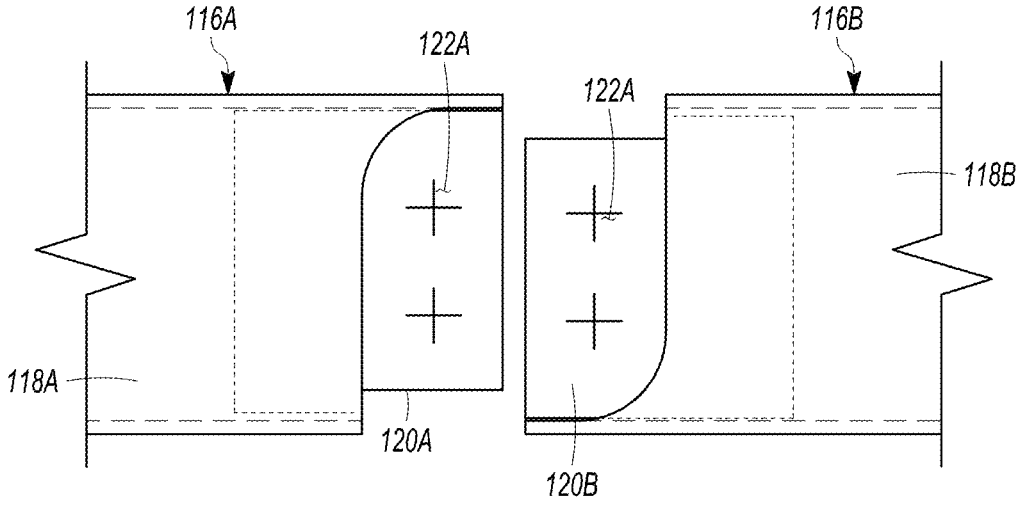
Figure 8C:
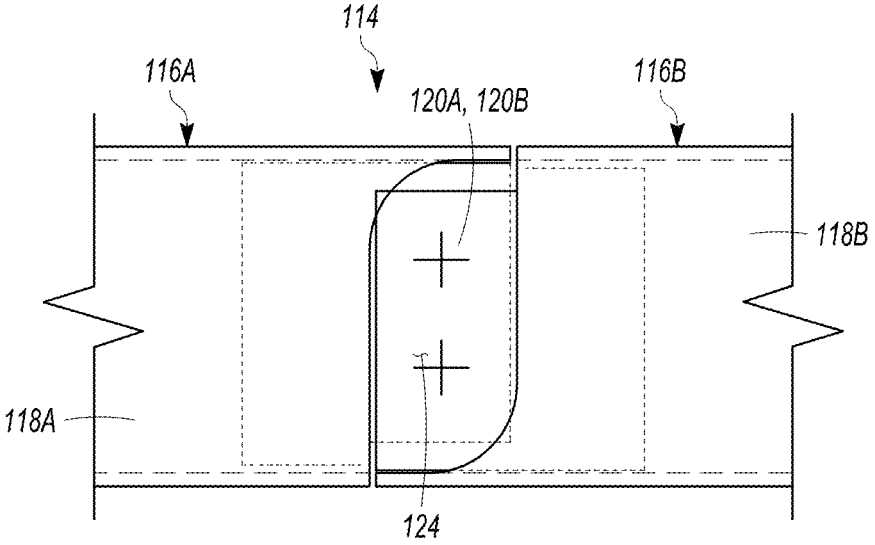
Figure 8D:
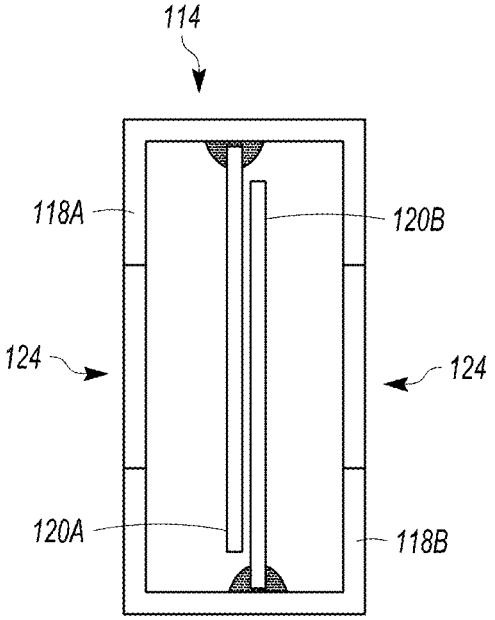
Figure 9:
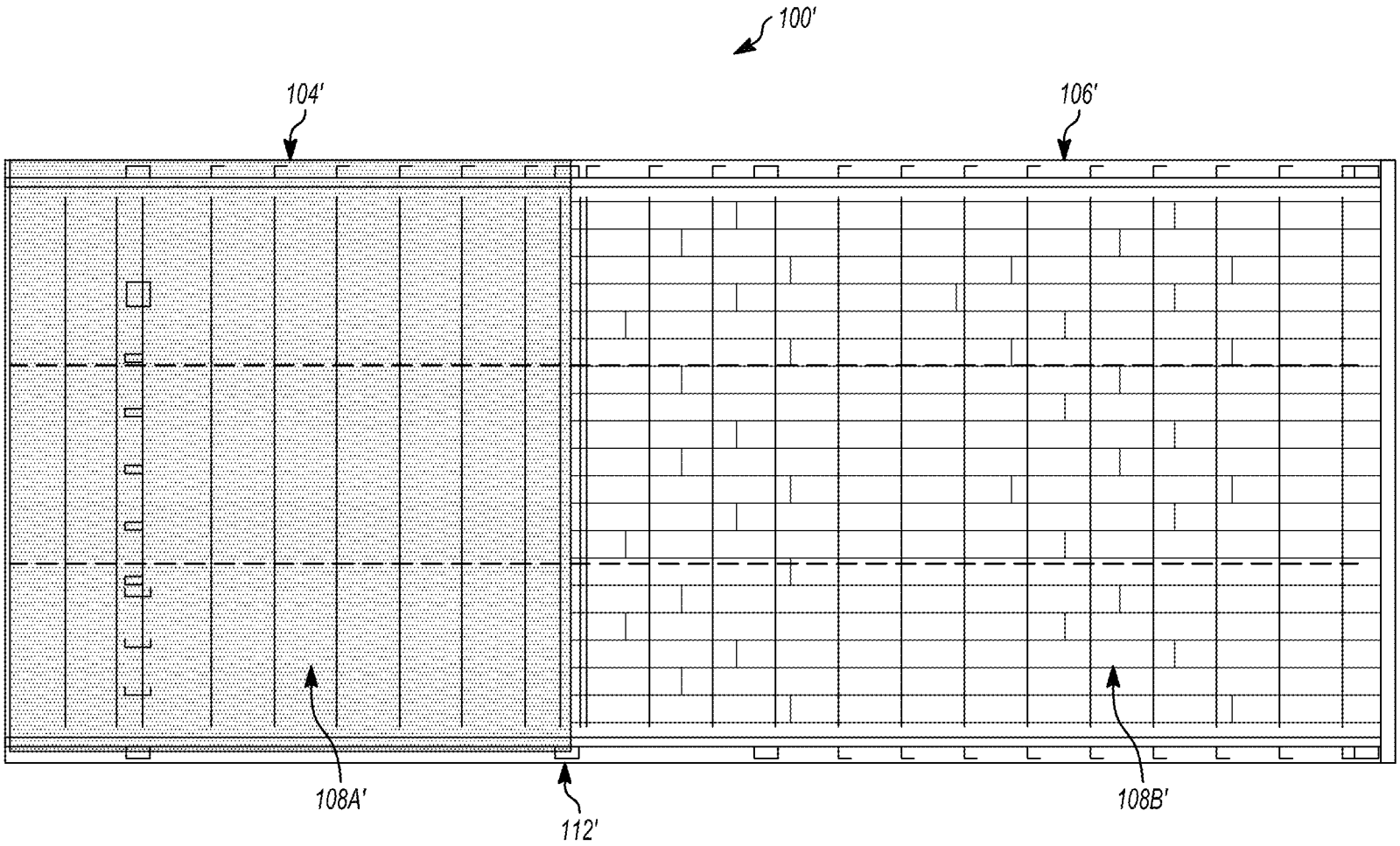
FIG. 9 a plan view of another embodiment of a modular building unit according to another embodiment of the present disclosure.
Figure 10:
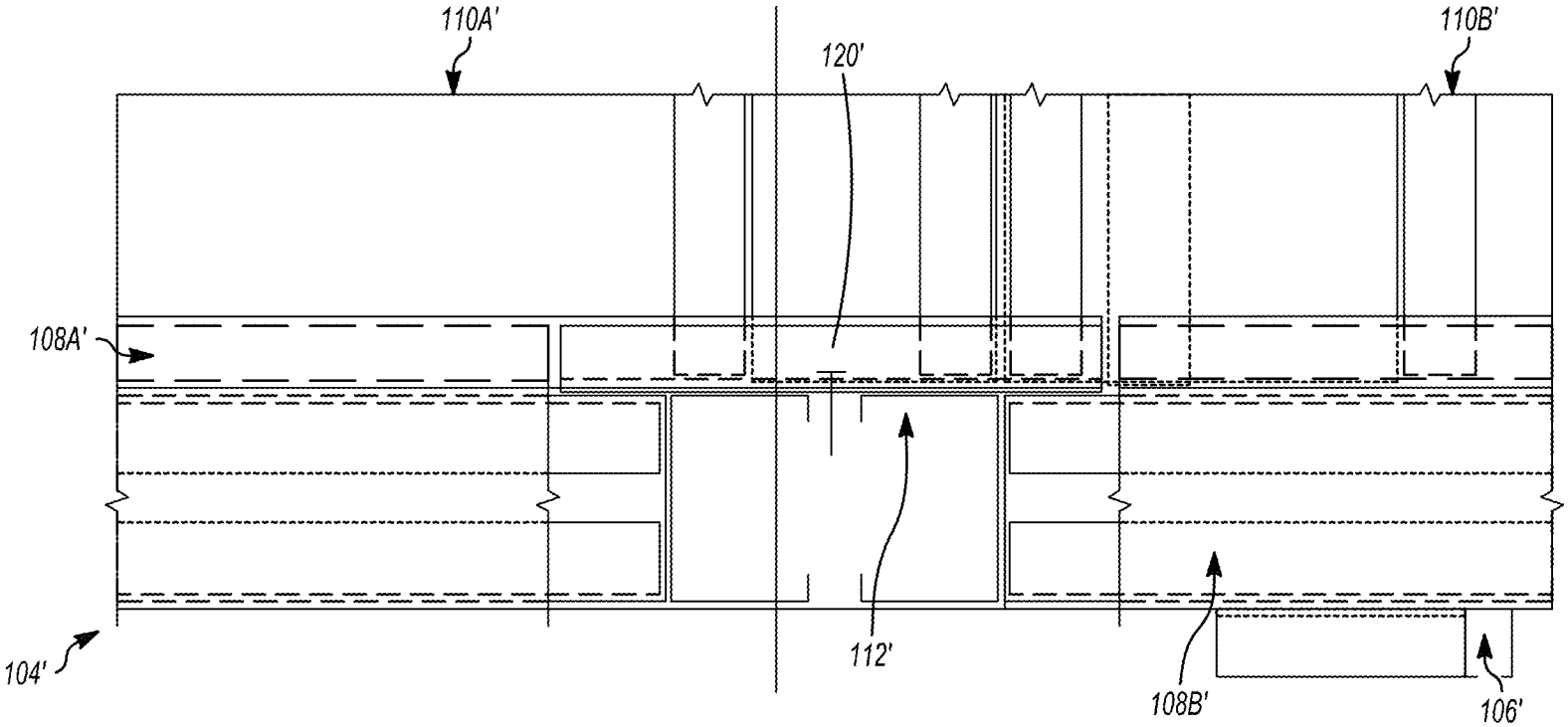
FIG. 10 an elevation view of a connection between modular sections of the modular building unit of FIG. 9.

Other configurations of the connection 112 are within the scope of the present disclosure. For example, with reference to FIGS. 9 and 10, in one embodiment, the modular building unit 100' includes a connection member or plate 120' that is a separate component that attaches to both the modular sections 104', 106' to couple the modular sections to one another. The modular building unit 100' of FIGS. 9 and 10 and its components is similar to the modular building unit 100 of FIGS. 2-8D and its components such that identical, similar, or analogous elements are labeled with the same reference numerals, with the addition of a trailing prime. The primary difference between the modular building units 100 and 100' is the connection 112, 112' between the modular sections. Another difference is that instead of being formed with HSS beams, the component beams are CFS. In the embodiment of FIGS. 9 and 10, the connection 112' comprises the connection member 120' that overlies or extends along the end portions of both modular sections 104', 106'. The connection member 120' is secured to both modular sections 104', 106' by any suitable means such as by welding or with one or more fasteners (e.g., bolts). The modular building unit 100' may include more than one connection member 120'. For example, one connection member 120 may be secured to the floor frames 108A, 108B and another connection member may be secured to the ceiling frames 111A, 111B. In another example of a connection, in one embodiment, the splice connection 114 may be omitted an instead a bolted connection, using connection brackets (as generally illustrated in FIGS. 5-7), is employed. In this embodiment, the connection may still include the connection member 120' as illustrated in FIGS. 9 and 10.

Referring back to FIGS. 2-7, the modular sections 104, 106 can include different utility structure (e.g., pipes, fittings, conduits, wires, fixtures, ductwork, etc.) that is supported by the respective modular sections. Different rooms may have different utility requirements. For example, a bathroom or a kitchen may have electrical, plumbing and/or gas utilities while other rooms, such as a dining room, living room, or family room may have only electrical utilities. Different rooms may also have the same or similar utility requirements, such as heating, ventilation, and air conditioning ("HVAC") or fire protection. The modular sections 104, 106 of the present disclosure allow the necessary utilities to be installed in each modular section corresponding to the room each modular section will house before the modular sections are coupled together.

When installed, generally, at least a portion of the utility structure will be disposed outside of the portion 102A, 102B of the interior space 102 the respective modular section 104, 106 defines. Typically, a portion of the utility structure will be disposed both inside and outside the portion 102A, 102B of the interior space 102 the respective modular section 104, 106 defines. Frequently, the utility structure will be at least partially disposed in the floor frame 108A, 108B, the wall frames 110A, 110B (one or both wall frames), and/or the ceiling frame 111A, 111B of the modular section 104, 106. For example, pipes (broadly, plumbing) of plumbing utility structure may extend along and within the floor frame 108A, 108B from different plumbing fixtures, such as a toilet, located in the portion 102A, 102B of the interior space 102 the respective modular section 104, 106 defines. The pipes of the plumbing utility structure may also extend along and within the wall frames 110A, 110B to reach and couple to other plumbing fixtures, such as a sink. A plumbing fixture could be any one of a sink, a toilet, a shower, or a bathtub. Other utility structures, such as electrical wiring, gas conduits, etc., can also extend along and within the floor frame 108A, 108B, ceiling frame 111A, 111B and/or wall frames 110A, 110B as desired in order to reach and be coupled to respective utility fixtures (e.g., lights, switches, outlets, gas appliances, etc.).

Being able to install utilities in modular building units, which is often done in a controlled factory setting, is one of the advantages to modular construction. The modular building unit 100 of the present disclosure, with its modular sections 104, 106, allows the utilities (broadly, at least a substantial portion thereof) to be installed in each modular section before the modular sections are coupled together to form the modular building unit. This combines the advantages that conventional pods offer in modular construction (e.g., enabling a room to be at least partially (if not generally completely) constructed on its own and then installed in place) without the drawbacks of conventional pods (e.g., the offset floor). Preferably, all the utilities are installed in the modular sections 104, 106 (broadly, the modular building unit) before the modular building unit is arranged at the building site to form the building. For example, preferably, the utilities can be installed before the modular sections 104, 106 are coupled together. In some embodiments, some additional utility installation for the modular building unit may occur after the modular sections 104, 106 are coupled together, such as connecting the electrical utilities between the two sections. In any event, preferably, no or minimal utilities are installed in the modular building unit once the modular building unit is positioned at the building site to form the building. The utilities of the modular building unit need only be connected to the utilities of the building.

It will be understood that the structural components making up the modular sections 104, 106 may be of any suitable material or combinations of such materials. In some embodiments, the structural components are primarily steel (including HSS steel components, cold formed steel (CFS) components, I-beams, etc.), while in other embodiments, the structural components are primarily dimensional lumber (including wood and manufactured or engineered wood).

Figure 11:
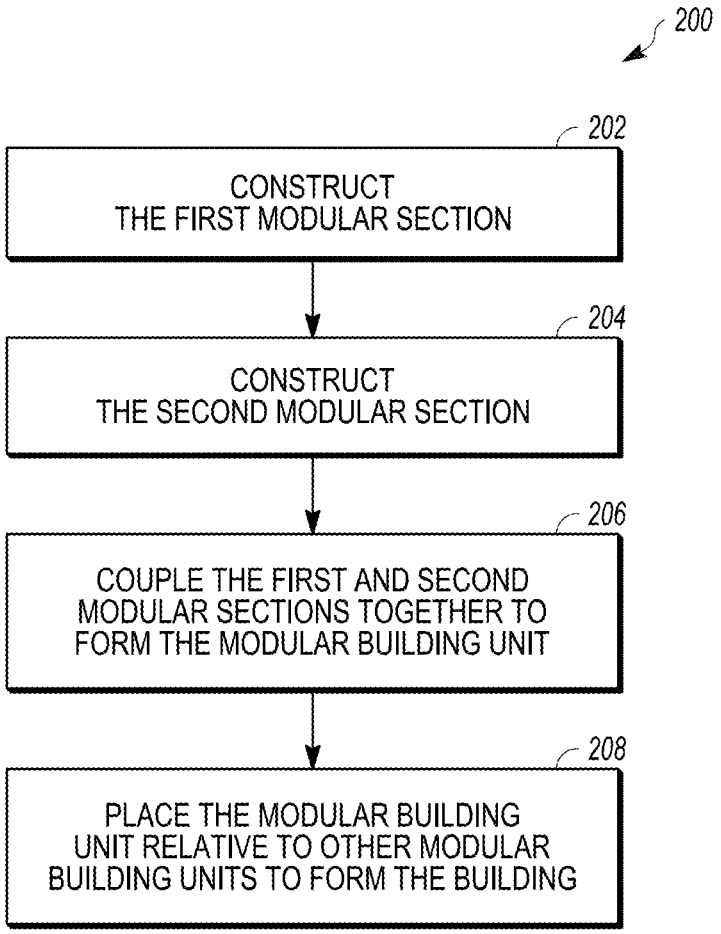
FIG. 11 is an example flow diagram of a modular construction method according to one embodiment of the present disclosure.

Referring to FIG. 11, an example flow diagram illustrating a method of modular construction using the modular building unit 100 of the present disclosure is generally indicated at reference numeral 200. In this method, first the modular building unit 100 is constructed. More specifically, at step 202 the first modular section 104 is constructed or built. This includes constructing or assembling the floor frame 108A, the frame walls 110A, the ceiling frame 111A (if present), and any other structures such as a ceiling or sub-ceiling, end walls, interior partition walls, etc. During and or after construction of these structures, components or elements of the room (broadly, at least a portion of the room) the first modular section 104 will house can also be constructed and/or installed. Building the room includes, for example, installing the utilities, such as in the floor frame 108A, ceiling frame 111A, and/or wall frames 110A. For instance, if the first modular section 104 will house a bathroom, electrical utility structures (e.g., wiring, switches, outlets, lights, etc.) and plumbing utility structures (e.g., plumbing (such as pipes, fittings, etc.), sinks, toilets, showers, bathtubs, etc.) are installed. In particular, electrical wiring can be installed in the floor frame 108A, the frame walls 110A, and/or the ceiling frame 111A. Likewise, plumbing can be installed in the floor frame 108A, ceiling frame 111A, and/or the frame walls 110A for carrying fluid (e.g., hot water, cold water, waste water). In the same manner, other utilities such as HVAC (e.g., ductwork, vents, fans, etc.), fire protection (e.g., pipes, pumps, fittings, sprinklers, etc.), etc. can also be installed in the first modular section 104. Typically, only the utilities that are needed for the particular room(s) the first modular section 104 will form will be installed. For example, plumbing will not be installed if the first modular section 104 will house a room not requiring plumbing utilities, such as a bedroom.

At step 204, the second modular section 106 is constructed or built. The process of constructing the second modular section 106 is generally the same as the process of constructing the first modular section 104. Thus, the description of the process of constructing the first modular section 104 equally applies to the process of constructing the second modular section. The primary difference between the process of constructing the first and second modular sections 104, 106 relates to the type of room the second modular section will house and what corresponding utilities and other features will be installed in the second modular section per the type of room. Because of the modular sections 104, 106, the modular building unit 100 of the present disclosure is especially well suited to define rooms requiring different utilities. For example, the modular building unit 100 of the present disclosure is especially well suited to define one room which requires plumbing utilities, such as a bathroom or kitchen which often requires plumbing to be routed within and/or through a floor, and another room which does not required plumbing utilities, such as a bedroom, a dining room, an office, a family room, or a living room. Therefore, in one method of construction, constructing the first modular section 104 includes building at least a portion of kitchen or at least a portion of a bathroom within the first modular section, and constructing the second modular section 106 includes building at least a portion of a bedroom, at least a portion of a dining room, at least a portion of an office, at least a portion of a family room, or at least a portion of a living room within the second modular section. These room types are not exhaustive and other room types may be used with and are within the scope of the present disclosure.

The construction of the first and second modular sections 104, 106 can occur generally simultaneously or one after the other (in either order). The construction of the first and second modular sections 104, 106 can take place at the same location or different locations. If constructed at different locations, one or both of the modular sections 104, 106 are be transported to the same location, which can be one of the sites the modular sections were constructed or a different site, such as the building site.

After the first and second modular sections 104, 106 are constructed and the desired elements (e.g., utilities) of the rooms the modular sections will house are installed, the first and second modular sections are coupled together, as described herein, to form the modular building unit 100, at step 206. The first and second modular sections 104, 106 can be coupled together at an assembly site (broadly, one or more assembly sites) remote from a building site where the building the modular building unit 100 will be a part of is being constructed. Preferably, the joining of the first and second modular sections 104, 106 occurs so that the floor frames 108A, 108B of the modular sections are generally aligned. As used herein "aligned" floor frames are preferably sufficiently aligned to form a continuous floor. More generally as used herein, "aligned" floor frames are preferably arranged so that a projection of the height of one floor frame intersects the opposite floor frame. Still further a splice connection of components (e.g., beams) that form a part of the structure of each modular section 104, 106 are connected together with a splice connection. If the first and second modular sections 104, 106 are attached to each other at a location remote from the building site, the modular building unit 100 is then transported to the building site. Alternatively, the first and second modular sections 104, 106 can be coupled together at the building site. In this case, the individual modular sections 104, 106 are transported, unconnected, to the building site. The first and second modular sections 104, 106 can be connected together using the structures and methods described previously herein.

At step 208, the modular building unit 100 is placed or arranged relative to other modular building units at the building site to form the building (broadly, at least a portion of the building). The other modular building units can include other modular building units 100 of the present disclosure and/or conventional modular building units. After, the modular building unit 100 is secured to the other modular building units and the utilities of the modular building unit are tied into the utilities of the building. After, additional modular building units are positioned at the building site to continue the construction of the building.

Other Statements of the Disclosure

The following are statements of example embodiments described in the present disclosure. Although some of the following statements are not currently presented as claims, the statements are believed to be patentable and may subsequently be presented as claims. Associated methods corresponding to the statements or apparatuses or systems below, are also believed to be patentable and may subsequently be presented as claims. Likewise, associated apparatuses or systems corresponding to the statements or methods below, are also believed to be patentable and may subsequently be presented as claims. It is understood that the following statements may refer to and be supported by one, more than one or all of the embodiments described above.

A1. A method of constructing a modular building unit configured to be placed with at least one other modular building unit for use in forming a building, the method comprising: constructing a first modular section having a first floor frame and a first wall frame extending up from the first floor frame, including the step of installing plumbing in at least one of the first floor frame and first wall frame for carrying fluid within in the first floor frame; constructing a second modular section having a second floor frame; and coupling the first and second modular sections to one another, said coupling including coupling the first and second floor frames to one another such that upper surfaces of the first and second floor frames are generally coplanar with one another.

A2. The method of statement A1, wherein said step of coupling the first and second modular sections occurs at one or more assembly sites remote from a building site where the modular building unit is placed with at least one other modular building unit for use in forming the building at the building site.

A3. The method of statement A1, wherein said step of coupling the first and second modular sections occurs at a building site where the modular building unit is placed with at least one other modular building unit to form the building.

A4. The method of any one of statements A1-A3, wherein said constructing the first modular section includes building at least a portion of kitchen or at least a portion of a bathroom within the first modular section, and wherein said constructing the second modular section includes building at least a portion of a bedroom, at least a portion of a dining room, at least a portion of an office, at least a portion of a family room, or at least a portion of a living room within the second modular section.

A5. The method of any one of statements A1-A4, wherein said coupling the first and second modular sections to one another includes splicing components of the modular sections together.

B1. A section of a modular building unit configured to be placed with at least one other modular building unit for use in forming a building, the section comprising: a floor frame; a wall frame connected to the floor frame and extending up from the floor frame; a first tubular beam connected to at least one of the floor frame and the wall frame; a connection member at least partially received in the first tubular beam configured for connection to another section of the modular building unit for use in forming the modular building unit; wherein the first tubular beam includes a cutout exposing at least a portion of the connection member to an outside of the tubular beam.

B2. The section of a modular building unit of statement B2, wherein the first tubular beam is part of the floor frame.

B3. The second of a modular building unit of statement B2, further comprising a ceiling frame connected to the wall frame, wherein the first tubular beam is part of the ceiling frame.

C1. A section of a modular building unit configured to be placed with at least one other modular building unit for use in forming a building, the section comprising: a floor frame; a wall frame connected to the floor frame and extending up from the floor frame; a connection member configured for connection of another section of the modular building unit for use in forming the modular building unit; wherein one of the floor frame and wall frame projects beyond the other of the floor fame and wall frame at an end of the section.

C2. The section of a modular building unit of statement C1, further comprising a ceiling frame connected to the wall frame, wherein one of the ceiling frame and wall frame projects beyond the other of the ceiling frame and wall frame at the end of the section.

D1. A method of constructing a building from modular building units comprising: constructing a first modular section having a first floor frame and a first wall frame extending up from the first floor frame; constructing a second modular section having a second floor frame and a second wall frame extending up from the first floor frame; coupling the first and second modular sections to one another to form a modular building unit defining one or more rooms; and placing the modular building unit together with other modular building units to form at least part of a building.

D2. The method of statement D1, wherein said step of coupling the first and second modular sections is carried out at an assembly site remote from a building site where said of placing the modular building unit occurs.

D3. The method of statement D1, wherein said step of coupling the first and second modular sections is carried out at a building site where said step of placing the modular building unit occurs.

D4. The method of either statement D2 or D3, wherein the first and second modular sections are assembled at remotely from the building site to form the modular building unit, and the modular building unit is transported to the building site.

D5. The method of statement D4, wherein the first and second modular sections are assembled at the same location.

D6. The method of statement D4, wherein the first and second modular sections are assembled at different locations.

D7. The method of any one of statements D1-D6, wherein the step of constructing the first modular section includes installing utilities in the first floor frame.

D8. The method of any one of statements D1-D7, wherein the step of constructing the second modular section includes installing utilities in the second floor frame.

D9. The method of any one of statements D1-D8, wherein each of the first wall frame and second wall frame defines at least a portion of the one or more rooms of the modular building unit.

D10. The method of any one of statements D1-D8 wherein coupling the first and second modular sections to each other comprises splicing beams from each of the first and second modular sections together.

Modifications and variations of the disclosed embodiments are possible without departing from the scope of the present disclosure defined in the appended claims. For example, where specific dimensions are given, it will be understood that they are exemplary only and other dimensions are possible.

When introducing elements of the present disclosure or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the disclosure, it is intended that all matter contained in the above description and shown in the accompanying drawings shall be interpreted as illustrative and not in a limiting sense.

What is claimed is:

1. A modular building unit having an interior space and configured to be placed with at least one other modular building unit for use in forming a building, the modular building unit comprising:

a first modular section including a first floor frame and a first wall frame extending up from the first floor frame, the first modular section defining a first portion of the interior space of the modular building unit, the first floor frame underlying the first portion of the interior space of the modular building unit, the first wall frame including a projecting first wall frame portion projecting outwardly from the first floor frame;

a second modular section including a second floor frame and a second wall frame extending up from the second floor frame, the second modular section defining a second portion of the interior space of the modular building unit, the second floor frame underlying the second portion of the interior space of the modular building unit, the second floor frame including a projecting second floor frame portion projecting outwardly from the second wall frame, the projecting first wall frame portion of the first modular section overlapping the projecting second floor frame portion of the second modular section; and a connection coupling the first modular section and the second modular section to one another, the first and second floor frames being generally aligned with one another.

2. The modular building unit of claim 1, wherein the first modular section includes a utility structure supported by the first modular section.

3. The modular building unit of claim 2, wherein the utility structure is supported at least partially outside of the interior space defined by the first modular section.

4. The modular building unit of claim 2, wherein the utility structure is disposed at least partially within the first floor frame.

5. The modular building unit of claim 2, wherein the utility structure comprises plumbing.

6. The modular building unit of claim 5, wherein the first modular section includes a plumbing fixture located in the interior space and coupled to the plumbing.

7. The modular building unit of claim 6, wherein the plumbing fixture comprises a sink, a toilet, a shower, or a bathtub.

8. The modular building unit of claim 1, wherein the first modular section houses a kitchen or a bathroom and the second modular section houses a bedroom, a dining room, an office, a family room, or a living room.

9. The modular building unit of claim 1, wherein the connection comprises at least one splice connection.

10. The modular building unit of claim 9, wherein the connection comprises a first connection element associated with the first modular section and a second connection element associated with the second modular section, the first and second connection elements being configured for connection to each other to form the modular building unit from the first modular section and the second modular section.

11. The modular building unit of claim 10, wherein the first connection element is a portion of the first flooring frame and the second connection element is a portion of the second flooring frame.

12. The modular building unit of claim 10, wherein the first and second connection elements each comprises a tubular beam and a connection member carried by the tubular beam.

13. The modular building unit of claim 12, wherein each of the connection members is located at least partially within the corresponding tubular beam and the corresponding tubular beam includes a cutout positioned to expose at least a portion of the connection member.

14. The modular building unit of claim 13, wherein the cutout of the tubular beam of the first connection element and the cutout of the tubular beam of the second connection element are configured to cooperatively form a window in the tubular beams upon connection of the first modular section to the second modular section for providing access to the connection members through the window.

15. The modular building unit of claim 9 wherein the splice connection comprises a first connection member and a second connection member, the first and second connection members extending on opposite sides of a joint between the first modular section and the second modular section.

16. The modular building unit of claim 1, wherein the modular building unit has a bottom and opposite first and second sides, the first and second modular sections each defining a portion of the bottom, a portion of the first side, and a portion of the second side.

17. The modular building unit of claim 1, wherein the first modular section includes a first ceiling frame, the first ceiling frame overlying the first portion of the interior space of the modular building unit, and wherein the second modular section includes a second ceiling frame, the second ceiling frame overlying the second portion of the interior space of the modular building unit.

18. The modular building unit of claim 17, wherein the first and second ceiling frames are generally coplanar with one another.

19. A section of a modular building unit configured to be placed with at least one other modular building unit for use in forming a building, the section comprising:

a floor frame;

a wall frame connected to the floor frame and extending up from the floor frame;

a first tubular beam connected to at least one of the floor frame and the wall frame;

a connection member at least partially received in the first tubular beam configured for connection to another section of the modular building unit for use in forming the modular building unit;

wherein the first tubular beam includes a cutout exposing at least a portion of the connection member to an outside of the tubular beam.

20. A modular building unit having an interior space and configured to be placed with at least one other modular building unit for use in forming a building, the modular building unit comprising:

a first modular section including a first floor frame and a first wall frame extending up from the first floor frame, the first modular section defining a first portion of the interior space of the modular building unit, the first floor frame underlying the first portion of the interior space of the modular building unit, at least one of the first floor frame and the first wall frame including a first projecting member extending laterally outward from the first modular section;

a second modular section including a second floor frame and a second wall frame extending up from the second floor frame, the second modular section defining a second portion of the interior space of the modular building unit, the second floor frame underlying the second portion of the interior space of the modular building unit, at least one of the first wall frame and the first floor frame including a second projecting member extending laterally outward from the second modular section; and a splice connection connecting the first modular section to the second modular section, the splice connection including a connection member secured to the first projecting member and the second projecting member thereby to connect the first and second modular sections for forming the modular building unit.

21. The modular building unit of claim 20 wherein the first and second projecting members are dimensional lumber.

22. The modular building unit of claim 20 wherein the first and second projecting members are steel components.

23. The modular building unit of claim 20 wherein the connection member overlaps the first and second projecting members.

24. The modular building unit of claim 20 wherein the first projecting member abuts the second projecting member in an end-to-end arrangement.

* * * * *